US006318831B1

(12) United States Patent
Baker

(10) Patent No.: US 6,318,831 B1
(45) Date of Patent: Nov. 20, 2001

(54) METHOD AND APPARATUS TO PROVIDE ADJUSTABLE EXCITEMENT OF A TRANSDUCER IN A PRINTING SYSTEM IN ORDER TO COMPENSATE FOR DIFFERENT TRANSDUCER EFFICIENCIES

(75) Inventor: Lamar T. Baker, Manhattan Beach, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/363,593

(22) Filed: Jul. 29, 1999

(51) Int. Cl.[7] ..... B41J 29/38; B41J 29/393
(52) U.S. Cl. ..... 347/14; 347/19
(58) Field of Search ..... 347/19, 46, 14, 347/15, 9, 54

(56) References Cited

U.S. PATENT DOCUMENTS 4,908,638 * 3/1990 Albosta et al. ..... 346/140 R
5,041,849 * 8/1991 Quate et al. ..... 347/46
5,389,956 * 2/1995 Hadimioglu et al. ..... 347/12
5,422,664 * 6/1995 Stephany ..... 347/14
5,519,419 * 5/1996 Stephany et al. ..... 347/19
5,847,724 * 12/1998 Mantell ..... 347/15

* cited by examiner

*Primary Examiner*—Huan Tran
*Assistant Examiner*—Juanita Stephens
(74) *Attorney, Agent, or Firm*—Kent Chen

(57) ABSTRACT

A method and apparatus for controlling power delivered from a power source to droplet sources in a printer is described. The described system uses a compensation value corresponding to each droplet source to compensate for differences between droplet sources. By using the compensation value to adjust the power delivered to each droplet source on a print head, a uniform droplet size is obtained from all droplet sources on the print head.

12 Claims, 7 Drawing Sheets

700

| LATCH DATA (Q1 Q0) | INJECTOR DRIVE |
|---|---|
| 00 | NO PRINT |
| 01 | 650 x 2 |
| 10 | 700 x 2 |
| 11 | 750 x 2 |

FIG. 7

METHOD AND APPARATUS TO PROVIDE ADJUSTABLE EXCITEMENT OF A TRANSDUCER IN A PRINTING SYSTEM IN ORDER TO COMPENSATE FOR DIFFERENT TRANSDUCER EFFICIENCIES

FIELD OF THE INVENTION

The present invention relates to printing systems. More specifically, the present invention relates to control circuitry used to control the output of droplet sources in a print head.

BACKGROUND

As computing products continue to drop in price while increasing in power, printing technology is driven by the need to reduce prices while improving printer resolution. One technology under development is acoustic ink printing (AIP). AIP printing systems use focused acoustic energy to eject droplets of a fluid onto a recording medium. The fluid is typically ink, although in specialized applications, the fluid may be a molten solder, a hot melt wax, a color filter material, a resist, and various other chemical and biological compounds.

In AIP systems, a print head ejects and deposits droplets on a recording medium to form an image. Tight control of droplet size and droplet distribution is important to obtain high resolution accurate images. Variations in droplet size and deviations in droplet placement degrade the resolution of images output by the AIP system.

A typical print head, such as an AIP print head, includes a number of droplet sources. In an AIP system for printing, these droplet sources are often wells containing ink. Acoustic energy generated by a transducer is directed to cause ejection of droplets of ink from the well. A variety of manufacturing techniques, typically semiconductor processing techniques, may be used to fabricate the transducer, the circuitry driving the transducers, and the wells. During the manufacturing process, slight variations in manufacturing parameters result in slight differences in each transducer and/or well on a print head. Transducer or well differences result in each droplet source outputting a slightly different droplet size. The different droplet sizes from different droplet sources on the same print head reduces accuracy and uniformity of a printed image.

The placement of droplet sources across a printhead also causes droplet size variations. In some embodiments of a printhead, a small number or even a single radio frequency (RF) source is used to drive multiple droplet sources distributed across a printhead. The transducers closest to the RF source receive more energy resulting in larger droplets being produced compared to transducers on the same print head positioned further away from the RF source. The difference in RF energy received by droplet sources on the same print head results in droplet size variations which reduce the accuracy and uniformity of outputted printed images.

SUMMARY OF THE INVENTION

Current print head designs utilize a plurality of droplet sources distributed across a print head to output a marking fluid onto a marking surface. However, differences in the formation and positioning of each droplet source result in differences in droplet sizes output from each droplet source. These differences degrade the accuracy and resolution of the print head. Thus, a method and apparatus for adjusting droplet size output from a droplet source on a print head is described.

In one embodiment of the invention, a circuit for controlling the output of a droplet source on a print head includes a memory element. The memory element stores a compensation value corresponding to the droplet source. The print head driver uses the stored compensation value to control energy from a driver element to adjust the output of the droplet source such that the size of the outputted droplets approximately matches a desired droplet size.

BRIEF DESCRIPTION OF THE DRAWINGS

A more complete appreciation of the invention will be more readily obtained and understood by referring to the following detailed description and the accompanying drawings.

FIG. 7 is a logic table illustrating possible inputs into the logic circuits of FIG. 5 and FIG. 6 and the resulting output.

DETAILED DESCRIPTION OF THE INVENTION

The present system describes a system to compensate for differences in droplet source characteristics. These different droplet source characteristics may arise from variations during the manufacture of the droplet sources or from the position of the droplet sources with respect to an energy source. The different droplet source characteristics produce variations in droplet sizes that degrade image quality. In one embodiment of the invention, a print head outputs a test pattern. The test pattern is examined and the droplet size output by each droplet source is determined and compared to a reference size. A compensation factor corresponding to each droplet source is then determined and stored in a nonvolatile memory. In subsequent printings of the print head, the compensation factor is used to adjust the output of a corresponding droplet source to achieve an approximately uniform droplet size from different droplet sources on the print head.

Figure 1:
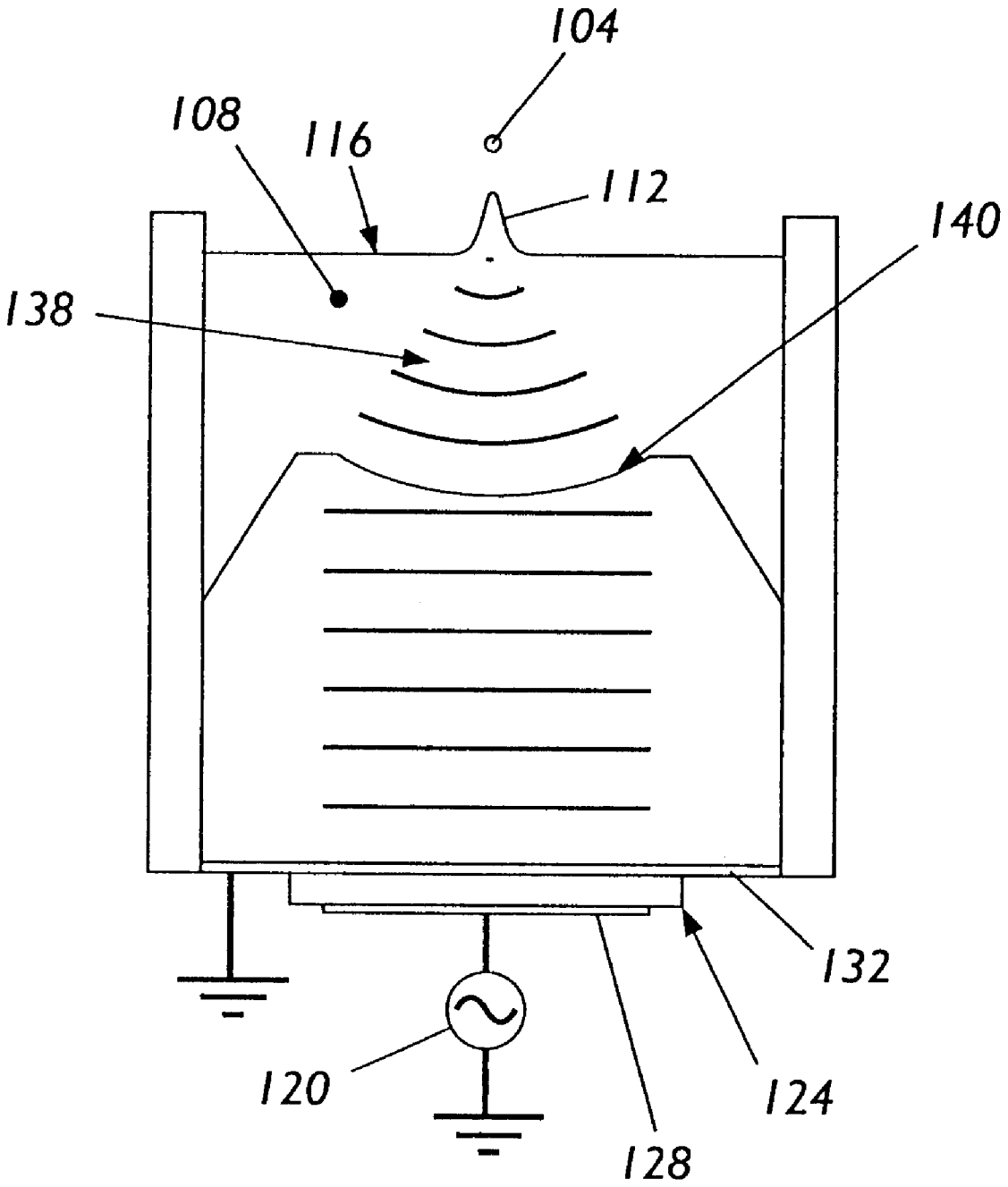
FIG. 1 illustrates a cross section view of one embodiment of an acoustic drop ejector which is shown ejecting a droplet of marking fluid.

FIG. 1 illustrates a cross sectional view of a typical droplet source 100 shortly after ejection of a droplet 104 of marking fluid 108 and before a mound 112 on a free surface 116 of marking fluid 108 has relaxed. A radio frequency (RF) source 120 provides a RF drive energy of around 100 to 200 Megahertz (MHz) to a driver element such as a transducer 124 via bottom electrode 128 and top electrode 132. In one embodiment, the transducer is a piezoelectric transducer. The acoustic energy from the transducer passes through a base 136 into an acoustic lens 140. Acoustic lens 140 focuses the received acoustic energy into a focused acoustic beam 138 which terminates in a small focal area near free surface 116. When sufficient acoustic energy is properly focused on free surface 116, a mound 112 is formed and a droplet 104 is ejected. A detailed description of a droplet source or "droplet ejector" is provided in U.S. Pat. No. 5,565,113 by Hadimioglu et al. entitled "Lithographically Defined Ejection Units" issued Oct. 15, 1996 and hereby incorporated by reference.

Figure 2:
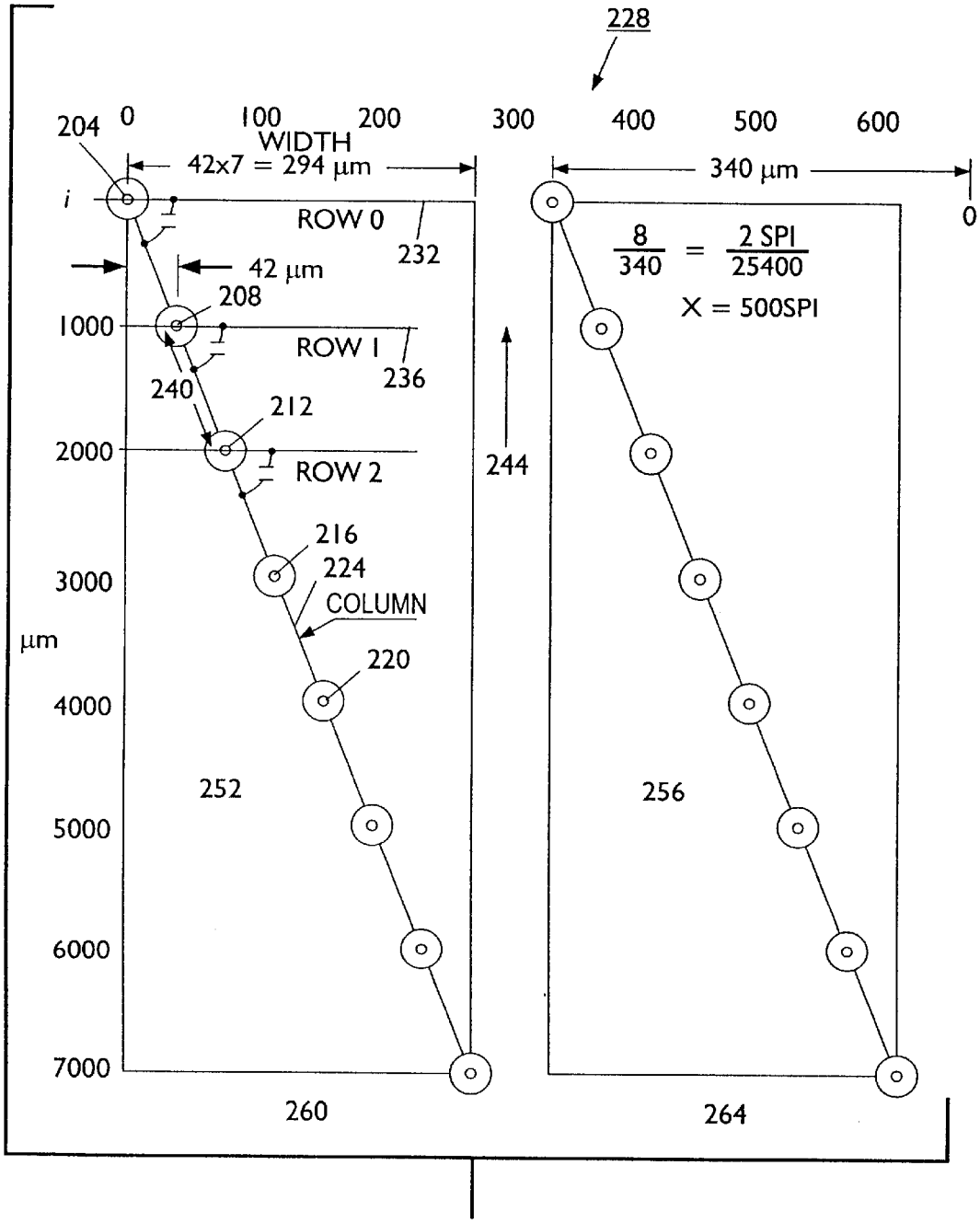
FIG. 2 illustrates a top view of a print head in one embodiment of the invention.

Each individual droplet source on a print head is typically fabricated as part of an array of droplet sources. FIG. 2 illustrates an example placement of droplet sources 204, 208, 212, 216, 220 in a column 224 of a print head 228. In the illustrated embodiment, print head 228 has a length of approximately 7000 micrometers and a width of approximately 700 micrometers although other dimensions are possible. Each droplet source, such as droplet source 204, is part of a row 232 of droplet sources. A distance of approximately 1000 micrometers separates adjacent rows 232, 236 on print head 228. An offset distance 240 of approximately 42 micrometers separates adjacent droplet sources in a column.

A typical color print head may be divided into several sections such as sections 252, 256, 260, 264. Each section includes an array of droplet sources that output a single color of marking fluid. By forming multiple sections, each section to output a corresponding color, by moving a recording medium relative to the print head at a controlled rate, and by correctly timing the ejection of each droplet source, proper placement of color marking fluid can be achieved. Arrow 244 indicates the movement of the recording media relative to the print head. Alternate embodiments include moving a print head across a stationary recording media or moving both the print head and the recording media in a predetermined pattern to produce a scanned image.

Figure 3:
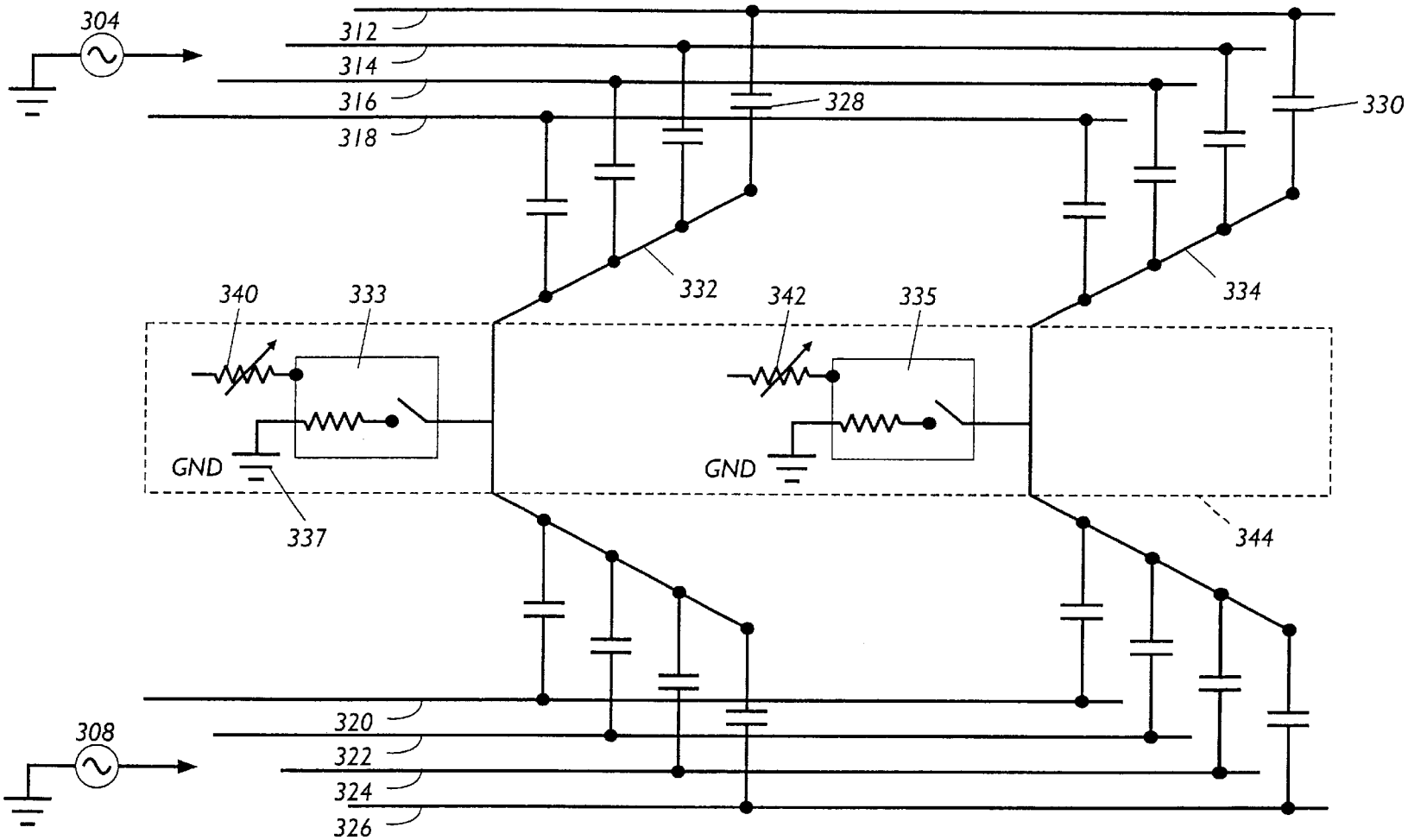
FIG. 3 illustrates one example of a switching architecture to direct energy from a high frequency source to a plurality of transducers.

FIG. 3 shows a switching architecture to direct RF energy from a RF energy source to a plurality of transducers. Each transducer provides acoustic energy for a corresponding droplet source. In the illustrated embodiment, two RF sources 304, 308 provide RF energy along row lines 312, 314, 316, 318, 320, 322, 324, 326. Each row line, such as row line 312, is coupled to one or more corresponding transducers, such as transducers 328, 330. The output of transducers 328, 330 are controlled by the signal along row line 312 and the signal transmitted along columns 332, 334. Only when RF source 304 provides a RF signal along row line 312 and an appropriate input is transmitted along column 332 does transducer 328 receive sufficient energy to output a droplet. In one embodiment of the invention, the "signal" along columns 332, 334 is determined by the setting of "three-terminal" switches 333, 335. When switch 333 is closed, column 332 is coupled to ground. When switch 333 is open, column 332 is left electrically floating. In one embodiment of the invention, each of the switches may be implemented as a "three-terminal switch" as described in U.S. Pat. No. 5,757,065 issued to Buhler, et al. and hereby incorporated by reference. By synchronizing the timing of the RF signal along row lines with the timing of the switches, the output of transducers 328, 330 can be independently controlled. In the illustrated embodiment, the timing of the switches is controlled by the timing of the injector current in each switch.

Figure 6:
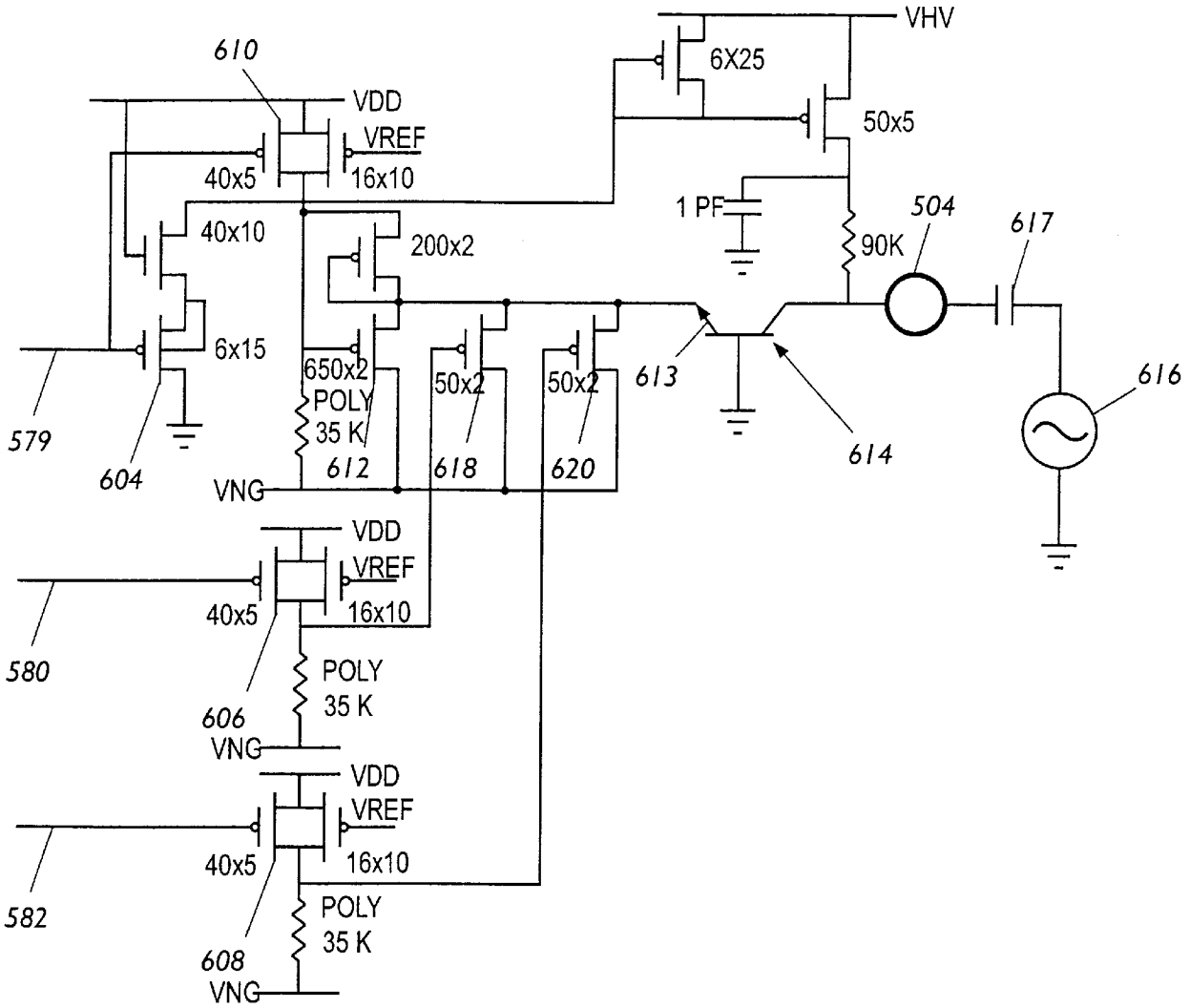
FIG. 6 illustrates a control circuit for controlling a driver which provides energy to the plurality of transducers.

In one embodiment of the invention, resistors 340, 342 are variable resistors. FIG. 6, discussed in further detail below, illustrates using metal oxide semiconductors (MOS) transistors for resistors 340, 342. The resistance of resistors 340, 342 controls the amount of current flowing from the transducers and along columns 332, 334. In one embodiment of the invention, switches 333, 335 and variable resistors 340, 342 may be implemented as a network on a chip 344 that forms part of the circuitry of a print head driver. As used herein, a print head driver is any circuit that controls the energy delivered to the transducer.

Typically, a switch supplies one of two discrete impedences (typically a "hi" value and a "low" value) to columns 332, 334. A change in the applied impedences changes the amount of current flowing through each transducer to either cause or prevent ejection of a droplet from a droplet source coupled to the transducer. One problem with coupling columns 332 and 334 to two discrete impedences is that transducers closer to the RF source, such as transducer 328 will receive more RF energy then transducers further away from the RF source such as transducer 330. The higher RF energy received by transducer 328 is due to line losses which occur in the line segment of row line 312 between transducer 328 and transducer 330. To compensate for the different positions of the transducer with respect to the RF source, as well as to compensate for differences among transducers resulting from variations during the transducer manufacturing process, the resistance of resistors 340, 342 may be adjusted to one of several values to compensate for the line losses which occur. Resistors 340, 342 are set to cause RF source 304 to deliver approximately equal amounts of power to transducer 328 and transducer 330.

Figure 4:
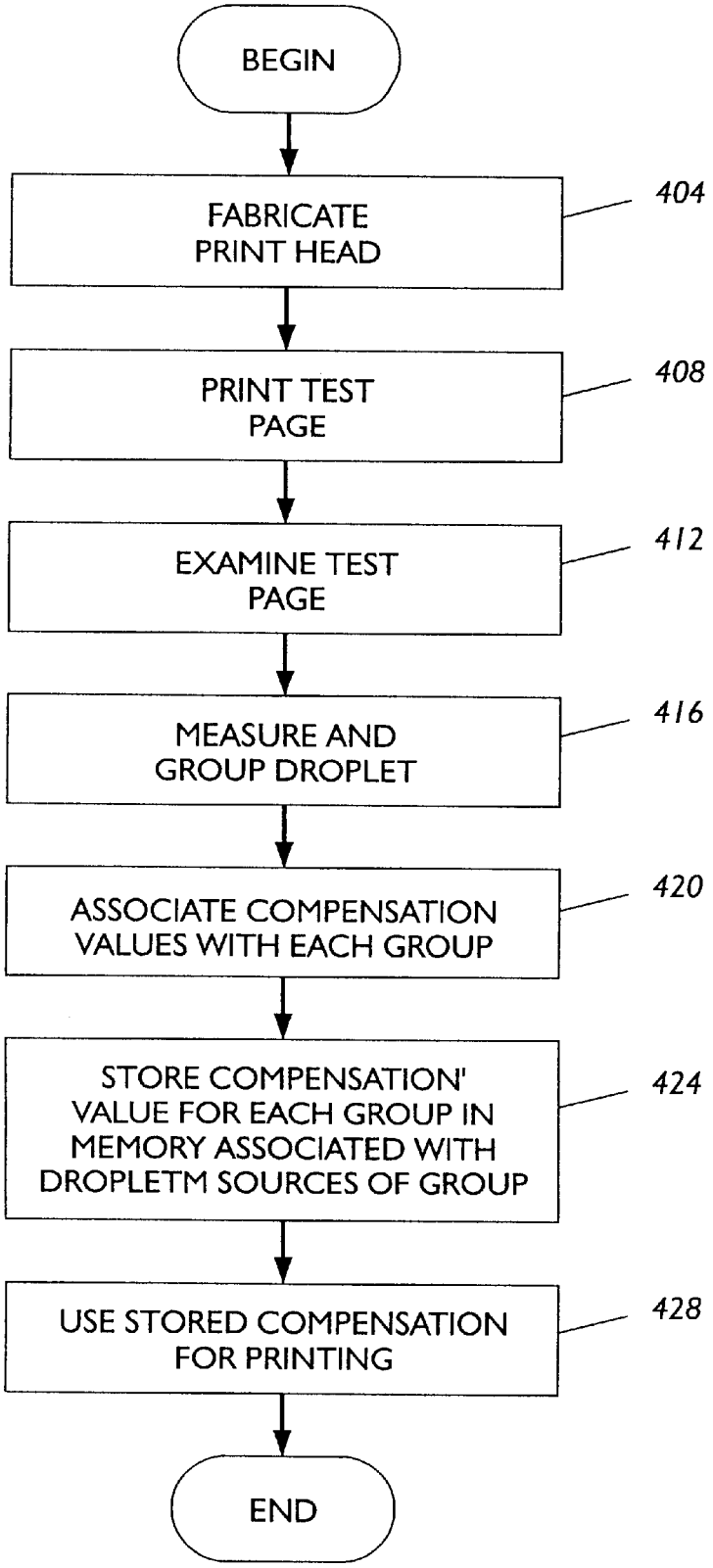
FIG. 4 is a flow diagram which illustrates one example of setting the control circuit to produce uniform drop size outputs.

FIG. 4 is a flow chart showing the calculation of a compensation value and the use of the calculated compensation value to adjust the RF energy received by a print head transducer. In block 404, a print head is fabricated. Fabrication of print heads is well known to those of skill in the art and typically uses semiconductor processing techniques such as photolithography. Each fabricated print head includes a number of droplet sources. These droplet sources may be used by ink-jet printers, acoustic-ink printers, or other devices for outputting a fluid.

In block 408, the print head prints a test page on a reference material such as a sheet of paper. When an acoustic ink printing head is used, the printing is done by sequentially transmitting energy from at least one RF source to each droplet source in a plurality of droplet sources. Each droplet source outputs or deposits at least one droplet of ink on the reference material.

In block 412, the test page is examined. The examination may be accomplished visually, or in mass production facilities, a scanning device may be used to electronically or optically scan the test page. One example of electronically scanning the test page uses an optical scanner to create a digital image of the test page. Signal processing circuitry processes the digital image to determine the size of each droplet on the reference material.

In block 416, each droplet is measured. The size of each droplet is compared to a reference and categorized or grouped into one of at least two categories. One method of measuring droplet size is to determine whether an area, circumference or other measurement of a droplet exceeds a predetermined threshold. A second method of measuring droplet size may be based on the color of the droplet, when more marking fluid is deposited, a darker colored droplet image results. One example of a typical three group categorization is (1) oversized droplets, (2) undersized droplets, and (3) properly sized droplets. Oversized droplets result when too much of a marking fluid is output by a droplet source. Undersized droplets result when insufficient marking fluid is output by the droplet source.

In block 420, a compensation value is associated with each group. The compensation value may be a preprogrammed or predetermined value. In other embodiments, the compensation value may be determined after measuring the droplet sizes in a group. For example, the compensation value associated with a group may be set according to the deviation of average droplet sizes in a group from a desired reference size. In block 424, the compensation value associated with the group is stored in memory locations. Each memory location corresponds to a droplet source that generated a droplet on the reference material. The memory locations are typically nonvolatile memory locations in EPROM or FLASH RAM. Using nonvolatile memory prevents data loss when power is disconnected from circuitry controlling the energy delivered to each droplet source. In alternative embodiments, the compensation value may be stored in a dynamic memory. Storage in a dynamic memory may be suitable when recalibration is needed due to changes in device characteristics over time.

During printing operations, the compensation values are used to adjust droplet source outputs. One method of adjusting the output of a droplet source in an AIP print head is to adjust the RF energy transmitted to the transducers of each droplet source. One method of adjusting the transmitted RF energy is to vary the output of the RF source in time, depending on which droplet source is being addressed. In an alternate embodiment, the resistance of a signal path may be adjusted to dissipate some of the transmitted RF energy thereby controlling the energy reaching the droplet source. Dissipating some of the RF energy before it reaches the droplet source reduces the size of droplets output by the droplet source. In a third embodiment, the embodiment of FIG. 3, the "three terminal" switches, 333, 335 provide an impedence to ground, GND, which is adjusted using a compensat ion value that corresponds to a droplet source being addressed. The impedence to GND (the "on" impedence) is varied by adjusting control resistors 340, 342 which varies the injector current thereby altering the "on" impedence. One mode for the described switch is a bipolar junction transistor (BJT) with a base coupled to ground, a collector coupled to column 332 and an emitter which controls the current flowing from column 332 to ground.

Figure 5:
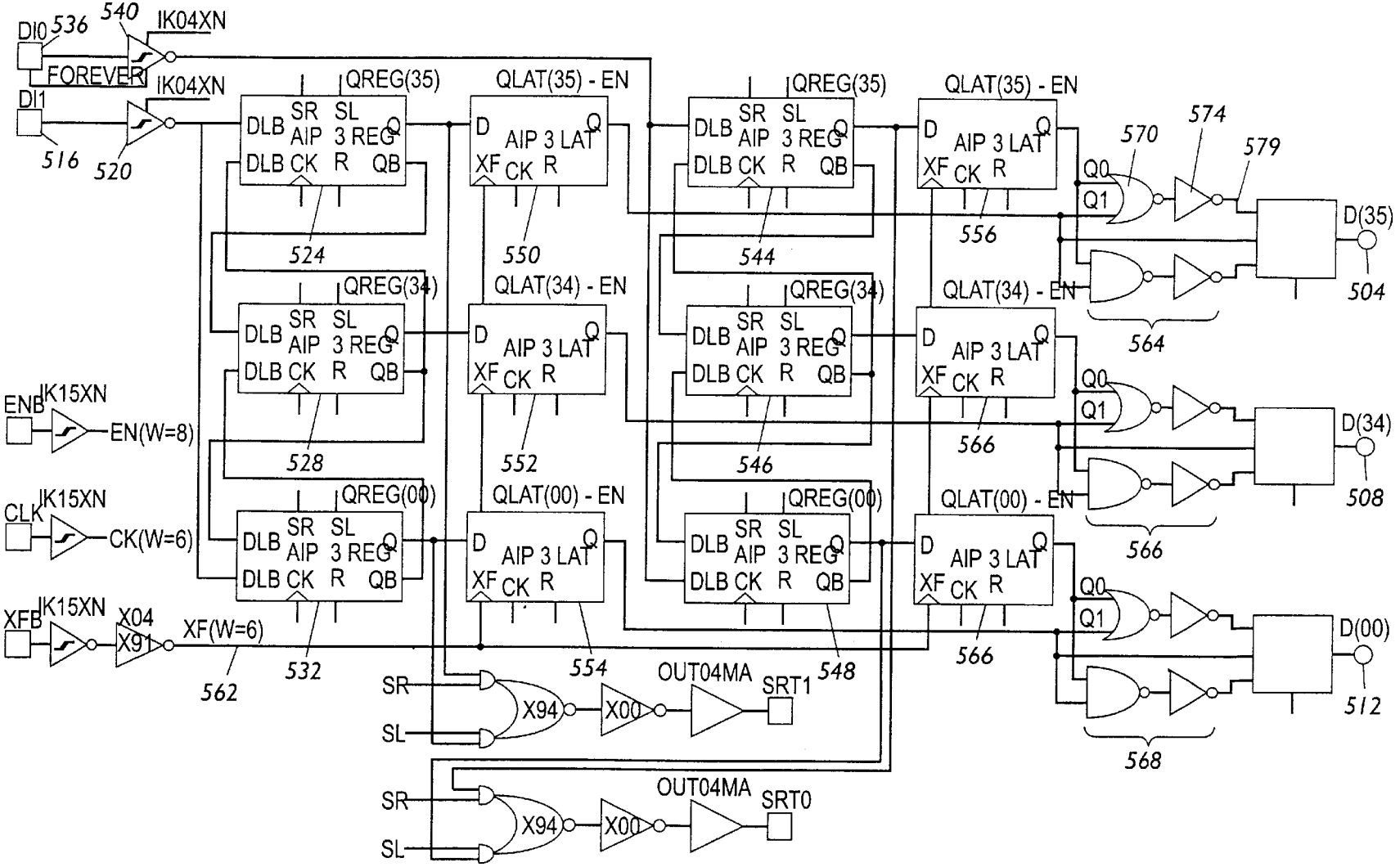
FIG. 5 shows one example of a driver circuit.

FIG. 5 shows a timing circuit 500 to properly time the output of two bit compensation values to allow different droplet sources on a print head to simultaneously output droplets. The timing circuit may have an arbitrary number "n" of inputs, although in the illustrated example, the timing circuit 500 includes 36 outputs such as outputs 504, 508, 512 to support up to 36 simultaneous outputs of droplets. At a point in time, each of the 36 outputs corresponds to a droplet.

A memory location (not shown) serially transmits a first bit of compensation data for the 36 droplet sources to be activated along input 516. Buffer 520 amplifies the incoming data and the first data bits are stored in serial data registers such as serial data registers 524, 528, 532. The memory location serially transmits a second bit of compensation data for the 36 droplet sources about to be activated along input 536. Buffer 540 amplifies the second bit of compensation data and the second data bits are stored in a second set of serial data registers such as serial data registers 544, 546, 548. In the illustrated embodiment, the serial loading registers are SR flip flops although many different types of storage devices may be used.

At an appropriate time, the serial data registers shift in parallel the stored compensation data into a series of data latches including data latches 550, 552, 554, 556, 558, 560. The data latches allow a trigger signal transmitted on input 562 to cause the data latches to output the compensation data to logic circuits 564, 566, 568. In the illustrated embodiment, a typical logic circuit 564 includes a NOR gate 570, a NAND gate 572 and two inverters 574 to convert the two bit compensation data into three bits for control of a high voltage (HV) driver circuit 576 and three terminal switch (not shown). In the illustrated embodiment, the HV driver circuit includes a variable resistance which changes with respect to the received compensation values. In one embodiment of the invention illustrated in FIG. 6, the variable resistance is achieved by switching switches controlled by input control lines 579, 580, 582 to add resistors, such as Metal Oxide Semiconductor MOS resistors, in parallel with a main resistor. Addition of parallel resistances reduces an overall resistance.

FIG. 6 illustrates one embodiment of a HV driver circuit 576 which receives an input along input control lines 579, 580, 582. As will be described, the circuit of FIG. 6 also illustrates one implementation of the switch 333 and resistor 340 combination illustrated in FIG. 3.

Each input control line switches a corresponding MOS transistor 604, 606, 608. The setting of MOS transistors 604, 610 determine whether the corresponding droplet source outputs a droplet. When input control line 579 is low, p channel transistor 610 is on and p channel MOS transistor 604 is on. Switching on MOS transistor 610 results in a positive voltage at a gate of transistor 612 switching transistor 612 off. Prevention of current flowing through switching transistor 612 also prevents current from flowing through the injector of a RF switch 614. In one embodiment of the invention, the RF switch is implemented as described in aforementioned U.S. Pat. No. 5,757,065 issued to Buhler et al. The lack of current flowing in the injector turns the "three terminal" switch off and thus prevents energy from being transmitted to a transducer for output of a droplet by a droplet source.

When the input carried by control line 579 changes state to high, transistor 610 switches off and transistor 604 switches off thereby connecting the gate of transistor 612 to approximately $V_{NG}$ (the negative supply voltage). Coupling the gate of main resistance transistor 612 to $V_{NG}$ switches main resistance transistor 612 "on" allowing current to flow from a source to a drain of main resistance transistor 612. Current also flows through the injector of RF switch 614. RF switch 614 and main resistance transistor 612 illustrate a specific implementation of the switch 333 and resistor 340 of FIG. 3. The injector current flow allows energy to flow from a source 616 through transducer 617 and bonding pad or output 504 to the GND. The energy flow causes output of a droplet from a corresponding droplet source. In a typical printing system, there are multiple transducers coupled to each column, and multiple columns coupled to a pad. Each pad is coupled to ground through a switch such as the previously described three terminal switch.

The current delivered to the injector 613 of RF switch 614 may be modified slightly using input control lines 580, 582 to switch MOS transistors 606, 608. A high signal applied to the gate of transistor 606 switches on corresponding compensating resistance transistor 618. The width of compensating resistance transistor 618 is significantly less than the width of resistance transistor 612. When resistance transistor 612 has a width of 650 microns, a typical width for compensating resistance transistor 618 would be 50 microns. The resistance offered by each resistance transistor is approximately proportional to a width of the resistance transistor. In one embodiment of the invention, resistance transistor 612 is the main resistance transistor and provides the primary current for causing vibration of the transducer to generate a droplet. However, when resistance transistor 612 is on, the addition of a second smaller resistance transistor, compensating resistance transistor 618 in parallel with resistance transistor 612 is sufficient to decrease the resistance of the combination and increase the injector current through RF switch 614. The increased injector current increases the energy delivered to the transducer resulting in an output of a slightly larger droplet than if compensating resistance transistor 618 was off.

Likewise control line 582 controls MOS switch 608 which controls a second compensating resistance transistor 620. The addition of second compensating resistance transistor 620 in parallel with resistance transistor 608 further reduces the effective resistance of the combination. Thus, when all three resistance transistors 612, 618, 620 are on, maximum injector current flows through RF switch 614 and a maximum droplet size is output. In the illustrated embodiment of FIG. 6, four different states are possible. The first state occurs when the transducer does not output a droplet. The first state occurs when the main resistance transmitter 612 and both compensating resistance transistors 618, 620 are off. In the embodiment of FIG. 5, the first state occurs when latch 550 and latch 556 both output low values "0"s to the inputs of NOR gate 570 and NAND gate 572.

The second state occurs when latch 550 outputs a low "0" value and latch 556 outputs a high "1" value. When the second state occurs, main resistance transistor 612 is on while compensating resistance transistors 618, 620 are both "off" resulting in a current approximately 7% below "normal" and a slightly smaller than "standard" droplet size.

The third state is a "normal" state which occurs when latch 550 outputs a high "1" value and latch 556 outputs a low "0" value. When the third state occurs, main resistance transistor 612 and compensation resistor 618 are on while the second compensation resistor 620 is off. The fourth state is when both latch 550 and latch 556 outputs a high "1" value switching on all resistance transistors 612, 618, 620 on. Switching all three resistance transistors 612, 618, 620 "on" minimizes the impedence, resulting in a current higher than "normal". The higher current delivers more power to the transducer resulting in a larger than "standard" size droplet. Logic circuitry prevents the compensating resistance transistors 618, 620 from switching on while main resistance transistor 612 is off.

For convenience, a summary of the possible states previously described is provided in the logic table 700 of FIG. 7. In FIG. 7, a first column includes Latch Data Q1 Q0. Latch data Q1 corresponds to the output of latch 550 and Q0 corresponds to the output of latch 556 of FIG. 5. The output of the two latches controls the injector drive current. A state indicating the effective width of the MOS resistance controlling the effective drive current is summarized in the second column of FIG. 7. For example, in the previously described second state, when latch 550 (Q1) outputs a low state and latch 556 (Q0) outputs a high state, only main transistor 612 is on while compensating resistance transistors 618, 620 are off. This second state results in an effective MOS resistance width of 650×2, which is approximately 7% lower than the "normal" effective resistance width of 700×2. The normal state is illustrated in the next row of FIG. 7 when latch 550 (Q1) outputs a high state and latch 556 (Q0) outputs a low state.

While the preceding invention has been described in terms of a number of specific embodiments, it will be evident to those skilled in the art that many alternatives, modifications, and variations are within the scope of the teachings contained herein. For example, dimensions of transistors, and use of the technology in alternative printing systems besides AIP printing systems are possible. Accordingly, the present invention should not be limited by the embodiments used to exemplify it, but rather should be considered to be within the spirit and scope of the following claims and its equivalents, including all such alternatives, modifications and variations.

What is claimed is:

1. A circuit for controlling a plurality of driver elements in an acoustic ink printing system, the circuit comprising:

a plurality of nonvolatile memory elements to store compensation values, each compensation value corresponding to a driver element in the plurality of driver elements;

a variable resistance coupled to the plurality of driver elements, the variable resistance to control energy delivered to the plurality of driver elements; and a print head driver to receive RF energy from a RF source, the resistance of the variable resistance changes in time, a value of the variable resistance at a particular time is set to correspond to the compensation value corresponding to the driver element outputting an ink droplet at the particular time, the value of the variable resistance controlling the amount of RF energy received by the driver element outputting the ink droplet at the particular time.

2. The circuit of claim 1 further comprising:

a print head including the driver element, and wherein the driver element is a piezo-electric transducer.

3. The circuit of claim 2 wherein the piezo-electric transducer couples to a fresnel lens for focusing ink ejected from the driver.

4. The circuit of claim 1 wherein the compensation value provides at least three different states, each of the three different states resulting in an output of a droplet of a corresponding size from a driver element.

5. The circuit of claim 1 wherein the compensation value determines a droplet size ejected from the driver element.

6. The circuit of claim 1 wherein the compensation value may have a first setting and a second setting, the first setting results in a current delivered to said driver element that is within 20 percent of the current delivered to said driver element when the compensation value is at the second setting.

7. A circuit for controlling a driver element comprising:

a memory element to store a compensation value;

a variable resistance, a value of the variable resistance set according to the compensation value, the variable resistance to control a current and an energy delivered to the driver element, the variable resistance including a plurality of metal oxide semiconductor transistors coupled in parallel, the resistance of the variable resistor reduced by switching on an additional metal oxide semiconductor transistors; and a print head driver to use the stored compensation value to adjust an output of the driver element between at least two states.

8. An acoustic ink printer comprising:

a plurality of nonvolatile memory devices to store a plurality of compensation values, each compensation value corresponding to a distance from a piezo-electric and a source of RF energy; and a variable resistor to use the plurality of compensation values to adjust vibrational energy of each piezo-electric in a plurality of piezo-electrics within a specified range, the intensity of the vibration to determine a liquid drop size for ejection from a print head coupled to said print driver.

9. The printer of claim 8 wherein the print head includes a plurality of piezo-electric drivers, each piezo-electric driver corresponding to a compensation value set to cause ejection of a liquid droplet of a standardized size.

10. The printer of claim 8 further comprising:

a variable resistors resistor coupled to the source of RF energy, the resistance of the variable resistor adjusted by the compensation value, a setting of the variable resistor to determine an amount of RF energy delivered from the source of RF energy to the piezo-electric.

11. A method of adjusting the output of a plurality of driver devices on a print head comprising:

determining when a first driver device is going to output a droplet of ink;

setting a variable resistor to compensate for differences in driver devices on the print head, the setting of the variable resistor to adjust the amount of energy delivered to the first driver device when the first driver device outputs the droplet of ink;

determining when a second driver device is going to output a second droplet of ink; and adjusting the setting of said variable resistor to adjust the amount of energy delivered to the second driver device when the second driver device outputs the second droplet of ink.

12. The method of claim 11 wherein the setting of the variable resistor includes an operation of switching semiconductor devices connected in parallel.

* * * * *